United States Patent [19]

Johannson

[11] 4,365,781

[45] Dec. 28, 1982

[54] METHOD AND APPARATUS FOR CASTING TUBULAR BODIES

[75] Inventor: Johannes Johannson, Caracas, Venezuela

[73] Assignee: Lagoven, S.A., Caracas, Venezuela

[21] Appl. No.: 250,325

[22] Filed: Apr. 2, 1981

[51] Int. Cl.[3] ..... E21D 10/00

[52] U.S. Cl. ..... 249/11; 249/178; 249/180; 249/184

[58] Field of Search ..... 249/11, 178, 180, 184

[56] References Cited

U.S. PATENT DOCUMENTS

| | | | |
|---|---|---|---|
| 1,047,102 | 12/1912 | Meinken | 249/179 |
| 1,118,558 | 11/1914 | La Mare | 249/179 |
| 1,983,117 | 12/1934 | Bishop | 249/178 |
| 2,306,503 | 12/1942 | Sarosdy | 249/11 |
| 2,315,634 | 4/1943 | McCall | 249/179 |
| 3,074,140 | 1/1963 | Balcomb | 249/180 |
| 3,749,352 | 7/1973 | Khodosh | 249/180 |
| 4,153,232 | 5/1979 | Burchett | 249/179 |

*Primary Examiner*—John A. Parrish

*Attorney, Agent, or Firm*—Beveridge, De Grandi & Kline

[57] ABSTRACT

A collapsible inner form for making tubular concrete products has upper and lower sections with rigid casting faces, and flexible side sections which buckle inwardly when the internal form is collapsed. Jacks are used to push wheels in the upper and lower sections outwardly against the cast product, forcing the sections to their collapsed positions. The inner form is movable on the wheels for removal of the inner form from the solidified cast product.

13 Claims, 5 Drawing Figures

METHOD AND APPARATUS FOR CASTING TUBULAR BODIES

BACKGROUND OF THE INVENTION

This invention relates to a method and apparatus for casting tubular bodies of concrete or other fluent solidifiable materials. The invention may be used for producing a wide variety of tubular products, although it was developed primarily for manufacturing concrete piles such as those used for monopile oil wells in Lake Maricaibo, Venezuela.

The prior art is replete with forms for casting concrete products. Examples may be found in the following U.S. patents which were located during a preliminary patentability search: Nos. 1,047,102; 1,118,558; 2,315,634; 3,074,140 and, 4,153,232. It is specifically noted that U.S. Pat. No. 3,074,140 to Balcomb et al. discloses an internal mold member which includes flexible strips which buckle inwardly when the mold is collapsed. The Burchett U.S. Pat. No. 4,153,232 shows a mold in which an internal form is collapsed by reaction forces created by bearing outwardly against the cast product.

A particular objective of the present invention is to provide an appropriate alternative process and apparatus to the centrifugal casting methods used heretofore for producing concrete piles. This objective has been realized by the invention disclosed herein which is capable of producing these and other products in a less complicated and less expensive manner.

SUMMARY OF THE INVENTION

According to one feature of the invention, a collapsible internal form for casting concrete or other fluent solidifiable material includes a plurality of sections which are movable toward and away from each other from an expanded position which they assume during casting to a contracted position which they occupy when the internal form is removed from the product. Each of the sections has a rigid outer casting face, a pusher member which is movable from a retracted position to an extended position where it projects outwardly beyond the casting face, and an actuator which is operable to move the pusher member to its extended position and consequently move the respective section toward its contracted position. Preferably, the pusher members are wheels which, when extended, are capable of rolling to facilitate removal of the inner form from the cast product. It is also preferred to provide two such wheels associated with a single actuator on the lower section, such wheels being laterally displaced on opposite sides of the central vertical longitudinal plane of the form. Also, it is desirable to provide the inner form with a pair of bendable side members which are connected to the rigid outer casting faces and have a flexibility which enables them to buckle inwardly toward the center of the form when the sections are moved to their contracted positions.

Other preferred features of the invention involve cover members which are positioned in the casting face and are displaceable therefrom in response to movement of the wheels or other pusher members to their extended positions. To assure symmetrical collapse of the apparatus to its contracted position, means are provided for maintaining the upper and lower sections of the form at a constant angular orientation relative to each other as they move between their expanded and collapsed positions. This includes a linear guide track affixed to one section, and guide bearings affixed to the other section, such guide bearings being engaged with the guide track and being mounted on elongated members which are located at opposite sides of the guide track.

Furthermore, the invention involves a method of making tubular bodies from concrete or other solidifiable fluent material. This method is performed by casting the solidifiable material into a tubular space located between an outer form and an inner form, moving the forms radially to separate them from the cast material, the moving of the inner form being performed by pressing outwardly on the cast material with wheels which are mounted on the inner form. The inner form, while supported on the wheels, is then longitudinally removed from the cast product.

DETAILED DESCRIPTION OF A PREFERRED EMBODIMENT

Figure 1:
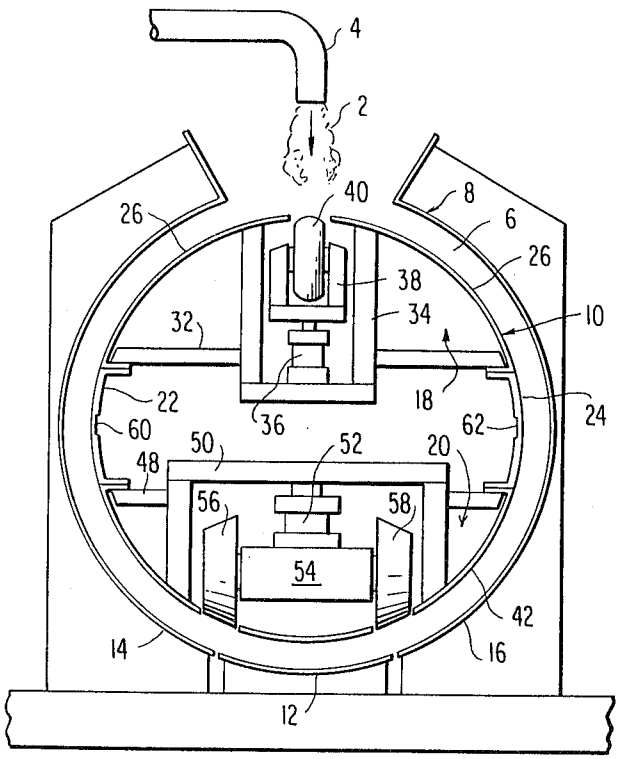
FIG. 1 is a diagrammatic transverse sectional view which shows the apparatus while concrete is being poured into the tubular space between the inner and outer forms.

As previously mentioned, the invention is applicable to the manufacture of tubular bodies of concrete or other solidifiable fluent materials. In FIG. 1, it will be seen that concrete 2 from a delivery hose 4 is being introduced into a tubular space 6 formed between an outer form 8 and an inner form 10.

The outer form 8 comprises a center section 12 and two side sections 14 and 16, the latter being spaced apart at the upper end of the apparatus to provide the opening for introduction of concrete into the tubular space 6 between the forms. Preferably, the outer form 8 is also provided with vibratory means and with tension members which span the space between the upper ends of the side sections 14 and 16 to hold them at a constant predetermined spacing.

The inner form 10 includes an upper section 18, a lower section 20 and a pair of bendable members 22 and 24 preferably formed of flexible polyurethane which is able to buckle inwardly toward the center of the form when the upper and lower sections are moved together as will be described hereinbelow.

The upper section 18 has a rigid outer casting face 26 which confronts the tubular space 6 where concrete is received. Arcuate ribs 28, longitudinal stringers 30 and struts 32, shown in FIG. 3, maintain this casting face in its rigid and unchanging configuration. Within the upper section 18, there is a support frame 34 which is immovable relative to the casting face 26. The frame 34 supports an actuator such as a hydraulic jack 36 which is operatively connected to the fork 38 of a rotatable wheel 40. Operation of the jack 36 moves the wheel 40 from the retracted position shown in FIG. 1, through a hole in the casting face 26 and to an extended position shown in FIG. 2 where it projects outwardly beyond the casting face. The wheel 40 pushes against the solidified product, creating reaction forces which move the upper section 18 downwardly toward its contracted position to separate it from the cast product.

Figure 2:
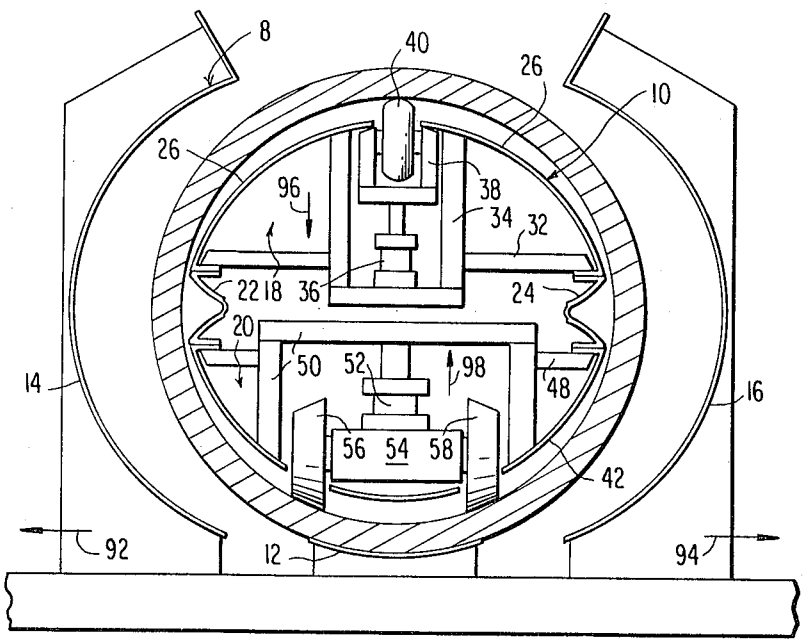
FIG. 2 is a diagrammatic transverse sectional view showing the apparatus while the inner form is contracted and is being longitudinally removed from the solidified product.
Figure 3:
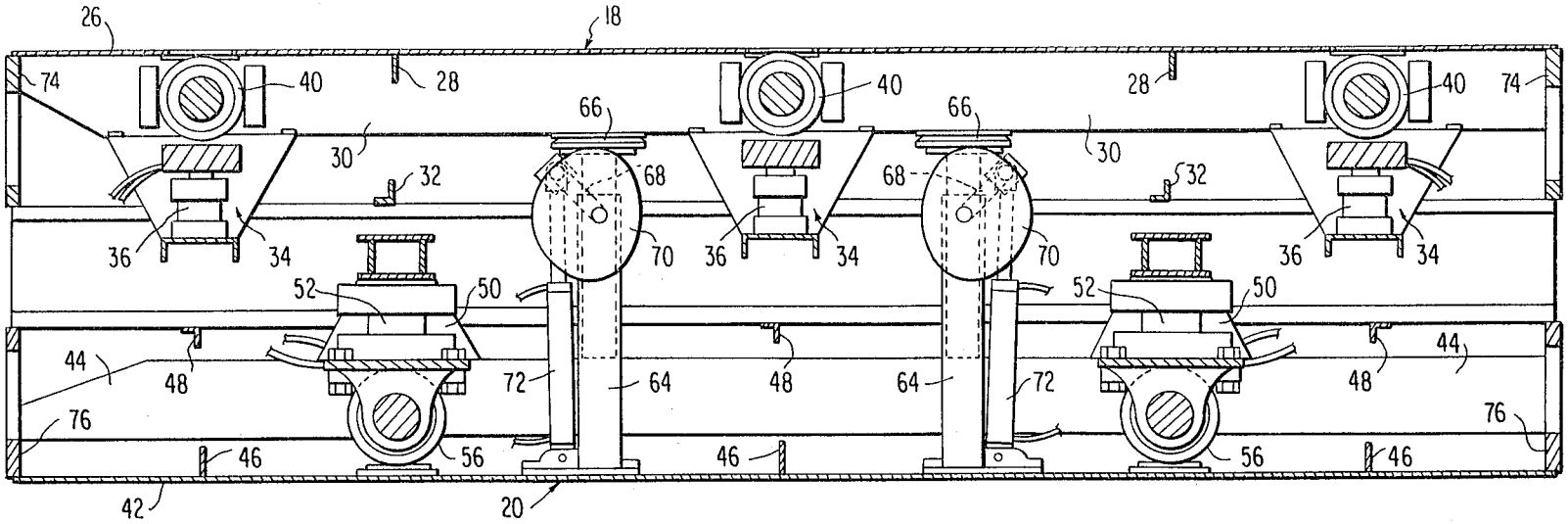
FIG. 3 is a longitudinal sectional view of the inner form when in its expanded position.

The lower section 20 of the inner form 10 is similar to the upper section 18. It has a rigid outer casting face 42. As shown in FIG. 3, it has longitudinal stringers 44, arcuate ribs 46 and struts 48 which prevent any distortions in the configuration of the casting face. An internal frame 50 which supports a hydraulic jack 52 is connected to the lower section 20. The outer end of the jack 52 is connected to a slidably guided block 54 upon which a pair of truncated conical wheels 56 and 58 are rotatably mounted. The wheels 56 and 58 are circumferentially spaced and are laterally displaced on opposite sides of the central vertical longitudinal plane of the form. The casting face 42 has openings aligned with the wheels 56 and 58 so that, upon expansion of the jack 52, the wheels will push outwardly beyond the casting face 42. When they do so after the cast material has solidified, they will bear against the product and push the frame 50 and the lower section 20 upwardly to the contracted position shown in FIG. 2.

To complete the substantially continuous cylindrical configuration of the casting face, and also to accommodate the contractive movement of the upper and lower sections of the inner form, side members 22 and 24 are connected to the upper and lower sections 18 and 20. These side members 22 and 24, being formed of flexible polyurethane, are able to buckle inwardly toward the center of the form when the sections are moved to their contracted positions as shown in FIG. 2. Longitudinal grooves 60 and 62 are located along the interior central portion of the side pieces to facilitate the buckling action and to ensure that buckling will occur in a symmetrical manner. The relative displacement of the members is greatly exaggerated in FIG. 2 for illustrative purposes.

FIG. 3 shows a longitudinal segment of the inner form 10, it being emphasized that many such segments may be connected together to provide an inner form of appropriate length for the product being manufactured. In FIG. 3, it will be seen that the upper actuators 36 and wheels 40 are longitudinally spaced from the lower actuators 52 and their wheels 56 and 58, these components being arranged to provide an appropriate force distribution in the apparatus. FIG. 3 also shows the mechanisms which move the upper and lower sections 18 and 20 to their expanded positions. Each of these mechanisms includes a vertical guide tube 64 which telescopically receives the shaft of a vertically movable bearing plate 66. The bearing plate 66 is engaged against the longitudinal stringers of the upper section. A crank arm 68 is pivotally mounted on the guide tube 64 and is affixed to a cam 70, the perimeter of which bears on the lower surface of the bearing plate 66. An hydraulic jack 72 has its lower end attached to a bracket on the lower section 20 and its upper end pivotally connected to the crank arm 68 so that expansion of the jack will produce a 90° rotation of the cam 70.

The orientation of the cams 70 is such that, when the jacks 72 are expanded, the high points on the cams 70 will contact the bearing plates 66 and move the upper and lower sections 18 and 20 apart to their expanded positions. Actuation of the jacks 72 in the opposite directions will rotate the cams 90° so that the low points on the cams 70 will contact the bearing plate, thus enabling the upper and lower sections 18 and 20 to move to their contracted positions.

Figure 4:
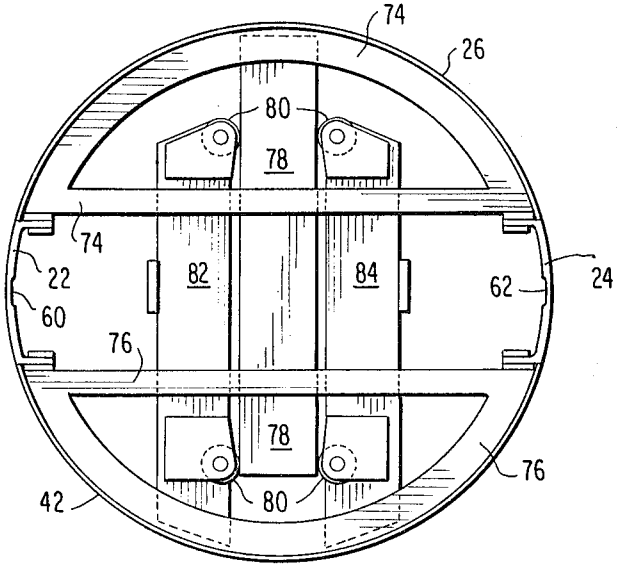
FIG. 4 is an end view of the inner form, illustrating the guide assembly which holds the upper and lower sections thereof at a constant angular orientation as they move between their expanded and contracted positions.

To prevent disorientation and asymmetrical contraction of the inner form, it is desirable to provide a guide means which holds the upper and lower sections 18 and 20 of the inner form 10 at a constant angular orientation relative to each other as they move from their expanded positions to their contracted positions. A preferred guide means is illustrated in FIG. 4, attached to the end plates 74 and 76 of the inner form sections 18 and 20. Each of these end plates is a unitary metallic plate which has a chordal portion and an arcuate portion. Depending from the upper end plate 74, and rigidly bolted to its arcuate and chordal portions, there is an elongated vertical linear guide track 78. The edges of this guide track 78 are engaged by rollers 80 which are connected to and vertically movable with the end plate 76 of the lower section 20. These rollers 80 are mounted on elongated members 82 and 84 which are located on opposite sides of the guide track 78. The elongated members 82 and 84 are bolted to the linear and chordal portions of the lower end plate. The rollers 80 act as rolling bearings which engage the edges of the guide track; and, their coaction with the guide track will hold the upper and lower sections 18 and 20 at a constant angular orientation relative to each other.

Figure 5:
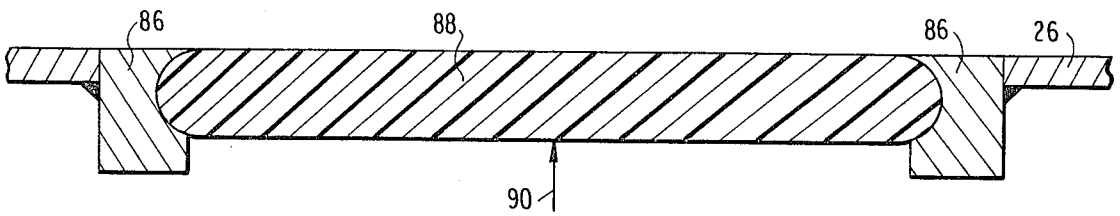
FIG. 5 illustrates one of the displaceable covers which may be used to cover the wheel openings in the casting face.

To prevent concrete from flowing into the interior of the inner form, it is desirable to provide some type of temporary cover for the wheel openings in the casting face. One suitable cover is shown in FIG. 5 where it will be seen that a rectangular frame 86 is welded to the casting face 26. The inner perimeter of the frame is provided with a groove of semicircular cross section. Snap-fitted into this groove is a piece 88 of bendable polyurethane. As will be readily understood, the piece 88 remains in position while concrete is introduced into the form and is being cured. When the time comes to remove the inner form, the wheel 40 is pressed by its respective actuator 36 against the polyurethane piece 88 in the direction of arrow 90, thereby displacing the piece 88 from the opening and exposing the wheel 40 so that, during its rolling movement, it will ride first across the piece 88 and then across the inner surface of the cast product.

From the foregoing, the manner of using the apparatus and practicing the method will be readily understood. The components are initially placed in the position shown in FIGS. 1 and 3, the jacks 72 maintaining the cams 70 in positions where the upper and lower sections 18 and 20 are in their expanded positions ready for casting. The double-acting jacks 36 and 52 are in a condition which holds the respective wheels in their retracted positions where they do not extend beyond the casting faces of their respective mold halves. The bendable side members 22 and 24 form a continuation of the rigid mold faces, and the outer mold sections 12, 14 and 16 are positioned so that their casting faces provide an interiorly-facing cylindrical casting surface. Preferably, covers such as 88 are positioned over the wheel openings in the casting faces 26 and 42.

Concrete is poured from any source such as hose 4 into the tubular space 6 between the inner and outer forms. After an appropriate time, two days being suitable, the product has cured sufficiently so that it may be removed from the form. The tension members connecting the upper ends of the outer form sections are removed, and the side sections of the outer form are moved laterally as indicated by the arrows 92 and 94 in FIG. 2. The cast product is at this time supported by the center section 12 of the outer form. The jacks 72 are actuated to move their cams 90° so that the mold halves will be able to move to their collapsed positions when separated from the interior of the cast product. Next, the actuators 36 are operated to move the upper wheels 40 to their extended positions as shown in FIG. 2. The wheels act as pusher members, bearing against the internal surface of the cast product and creating a reaction force which drives the upper section 18 downwardly in the direction of arrow 96, thereby separating the casting surface of the upper section from the internal wall of the product.

Next, the lower actuators 52 are operated, causing the lower wheels 56 and 58 to push against the interior wall of the product and driving the lower section upwardly in the direction of arrow 98 to its collapsed position shown in FIG. 2. The collapsing of the mold sections applies a compressive force to the flexible side members, until such time that they buckle inwardly to the position shown in FIG. 2.

With the apparatus positioned as shown in FIG. 2, the form is pulled longitudinally by a chain and winch to remove the inner form longitudinally from the product. During this movement, the inner form is supported in a stable position by the pairs of wheels 56 and 58 which rotate to minimize any movement-resisting friction. The cast product is then removed and transported to another location. The outer and inner forms 8 and 10 are returned to the position shown in FIG. 1. In this position, the inner form is supported by spacer blocks which rest on the center segment of the outer form, in a manner well known in the art.

Persons familiar with the art will realize that the invention may take many forms other than the preferred embodiment disclosed, and that certain standard engineering practices may be applied to the disclosed system. For example, it is desirable to provide the frames with supplemental guide tracks which engage the wheel-supporting structures and guide them for movement in directions parallel to the arrows 96 and 98. The wheels 40, 56 and 58 may have polyurethane tracking surfaces. Non-circular tubular forms and products may be used and made. Many different types of actuators and mechanisms may be used in lieu of the illustrated hydraulic jacks 36, 52 and 72. Pusher members other than rotatable wheels are also suitable. In view of the diverse forms which the invention may take, it is emphasized that the invention is not limited to the disclosed embodiment but is embracing of modifications thereof and improvements thereto which fall within the spirit of the following claims.

I claim:

1. A collapsible internal form for use in casting a fluent solidifiable material such as concrete, comprising, a plurality of sections which are movable toward and away from each other from an expanded position which they assume when fluent material is cast thereabout to a contracted position which they occupy when the form is removed from a solidified body of cast material, each of said sections having a rigid outer casting face, a pusher member and an actuator means, each of said pusher members being movable relative to its respective section from a retracted position to an extended position where it projects outwardly beyond the face and bears against a solidified body of cast material, each of said actuator means being operable to move a pusher member from its retracted position to its extended position and to produce reaction forces which move the respective section toward its contracted position, said pusher members having their extended positions located so as to hold the casting faces of the sections in spaced relationship from the solidified body of cast material formed thereby.

2. A collapsible internal form according to claim 1 wherein the rigid outer casting faces of the sections are spaced apart, said apparatus having bendable members which connect the rigid outer casting faces to provide a substantially continuous outer casting face, said bendable members having a flexibility which enables them to buckle inwardly toward the center of the form when the sections are moved to their contracted positions.

3. A collapsible internal form according to claim 1 or claim 2 wherein the pusher members are wheels which support the form for longitudinal movement when it is in its contracted position.

4. A collapsible internal form according to claim 3 including cover members located in said casting face over the pusher members when they are in their retracted positions, said cover members being displaceable from the casting face in response to movement of the pusher members to their extended positions.

5. A collapsible internal form according to claim 3 having guide means for holding the sections at a constant angular orientation relative to each other as they move between their expanded and contracted positions.

6. A collapsible internal form according to claim 5 wherein the guide means includes a linear guide track affixed to one of the sections, and guide bearings affixed to another one of the sections, said guide bearings being in engagement with the guide track to hold the sections at a constant angular orientation as they move from their expanded to their contracted positions.

7. A collapsible internal form according to claim 6 wherein the guide bearings are supported on elongated members which are located on opposite sides of the guide track.

8. A collapsible internal form according to claim 3 in combination with an outer form which is in spaced surrounding relation thereto.

9. A collapsible internal form according to claim 3 wherein there are two said sections, one of which is an upper section and the other of which is a lower section, said lower section having two circumferentially spaced said pusher members which are laterally displaced on opposite sides of the central vertical longitudinal plane of the form.

10. A collapsible internal form according to claim 9 wherein there is a single actuator means connected to the two pusher members on the lower section.

11. A collapsible internal form according to claim 1 having guide means for holding the sections at a constant angular orientation relative to each other as they move between their expanded and contracted positions.

12. A collapsible internal form according to claim 11 wherein the guide means includes a linear guide track affixed to one of the sections, and guide bearings affixed to another one of the sections, said guide bearings being in engagement with the guide track to hold the sections at a constant angular orientation as they move from their expanded to their contracted positions.

13. A collapsible internal form according to claim 12 wherein the guide bearings are supported on elongated members which are located on opposite sides of the guide track.

* * * * *